United States Patent [19]

McStravick et al.

[11] 4,421,174

[45] Dec. 20, 1983

[54] CYCLIC ANNULUS PRESSURE CONTROLLED OIL WELL FLOW VALVE AND METHOD

[75] Inventors: David M. McStravick, Houston; Neil H. Akkerman, Kingwood, both of Tex.

[73] Assignee: Baker International Corporation, Orange, Calif.

[21] Appl. No.: 282,639

[22] Filed: Jul. 13, 1981 (Under 37 CFR 1.47)

[51] Int. Cl.[3] ..... E21B 34/10

[52] U.S. Cl. ..... 166/374; 166/72; 166/321; 251/57

[58] Field of Search ..... 166/323, 72, 373, 374, 166/319, 321

[56] References Cited

U.S. PATENT DOCUMENTS

| | | | |
|---|---|---|---|
| 3,842,913 | 10/1974 | Moh | 166/374 |
| 3,976,136 | 8/1976 | Farley et al. | 166/374 |
| 4,044,829 | 8/1977 | Jessup et al. | 166/374 |
| 4,326,585 | 4/1982 | McStravick | 166/72 |

*Primary Examiner*—William F. Pate, III

*Attorney, Agent, or Firm*—Norvell & Associates

[57] ABSTRACT

A method and apparatus are provided for operating a two position flow valve disposed in a subterranean well, for example a safety valve located near the bottom of a subterranean well, through the application of cyclic pressure applied to fluid confined in the annulus between conduits, such as well casing and a production string. Valving apparatus is provided adjacent to the flow valve to be controlled which derives a pressure signal from the cyclic pressure of the fluid annulus which is effective to maintain the valve in one of its two positions so long as the cyclic pressure exists, but permits the valve to shift to its other position upon termination or significant reduction of the cyclic pressure. In this manner, reliable operation of a flow valve, such as a safety valve, may be achieved without the necessity of running any auxiliary hydraulic control lines to such valve.

11 Claims, 4 Drawing Figures

CYCLIC ANNULUS PRESSURE CONTROLLED OIL WELL FLOW VALVE AND METHOD

BACKGROUND OF THE INVENTION

1. Field of the Invention

The invention relates to a method and apparatus for controlling the operation of flow valves disposed in a subterranean oil well, particularly safety valves located near the bottom of a well.

2. Description of the Prior Art

A safety valve is installed in a subterranean well to insure that the production flow can be reliably interrupted in the event of any emergency, such as a fire at the well head. The prior art is replete with examples of operating mechanisms for safety valves, and a description of the common problems encountered with the prior art mechanisms may be found in U.S. Pat. No. 3,831,632 to Young.

SUMMARY OF THE INVENTION

This invention provides a method and apparatus for effecting the operation of a two position flow valve in a conduit of an oil well, and particularly a safety valve located above the production zone or zones of a subterranean well, by utilizing cyclic pressure variations of fluid confined in the annulus between conduits, such as the well casing and the production string. Such cyclic fluid variation is produced at the well head by suitable pumping apparatus and, adjacent to the flow valve installation in the well, a hydraulically operated mechanism, including valves and pressure accumulators, is provided which effects the conversion of the cyclic pressure into a pressure signal. The signal is applied to the flow valve in opposition to the spring or other form of bias normally maintained on the actuator plunger of such flow valve to keep it in one of its two positions (open or closed). So long as the cyclic pressure exists in the casing fluid, the valve is maintained in the other position, but on termination of the cyclic pressure, the aforementioned hydraulic apparatus functions to decrease the pressure signal applied to the actuating plunger and permit the plunger to move to its spring biased position, thus opening or closing the valve as the case may be. The surface pump which generates the cyclic annulus pressure can be controlled manually or automatically with conventional electronic or pneumatic components so that conventional surface safety systems can be employed to shut in the downhole safety valve.

Utilization of the method and apparatus of this invention eliminates the necessity for running separate hydraulic or mechanical lines down the well casing to the valve, and yet provides reliable operation of the valve as a function of the existence of the cyclic pressure applied at the well head to the casing or well fluid.

DESCRIPTION OF THE PREFERRED EMBODIMENTS

Figure 1:
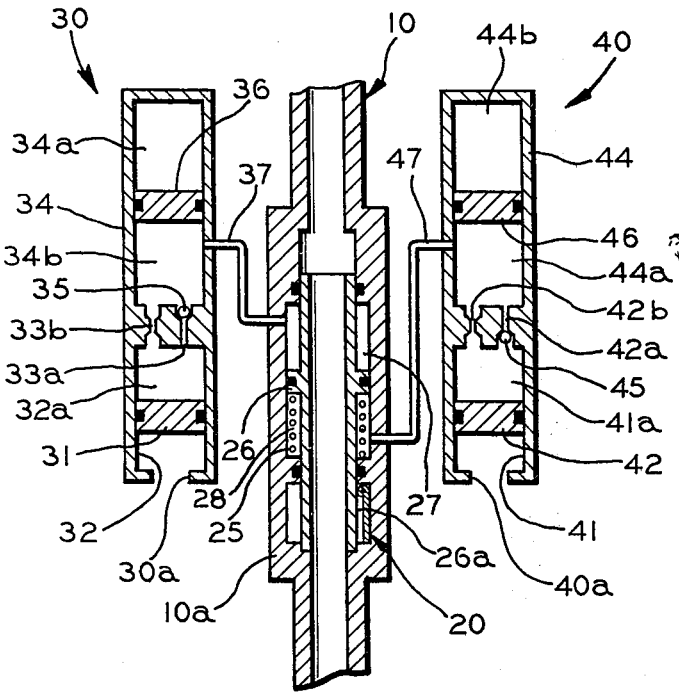
FIG. 1 is a schematic hydraulic diagram of the apparatus employed to operate a fluid flow valve disposed in the production casing of a subterranean well in accordance with this invention.

Referring to FIG. 1, the numeral 10 schematically represents a section of a production tubing of an oil well which is radially enlarged as indicated at 10*a* to provide a housing for a flow valve 20. A compression spring 25 normally operates on one side of an annular valve actuating piston 26 and imposes a bias on such piston, which is directly connected to the control valve 20 by annular plunger portion 26*a*, to maintain the control valve 20 in either an open or a closed position, depending on the function of the particular flow control valve. If the particular valve is to be employed as a safety valve, then the upward bias of spring 25 will be effective to maintain the valve 20 in a closed position.

Cylinder chambers 27 and 28 are respectively provided on opposite sides of the piston 26, and a signal, derived from a high pressure controller 30, is applied to the one cylinder chamber 27 in opposition to the bias imposed by the spring 25, and a pressure signal from a low pressure controller 40 is applied to the other cylinder chamber 28 and acts on the piston 26 in the same direction as the spring 25.

Figure 2:
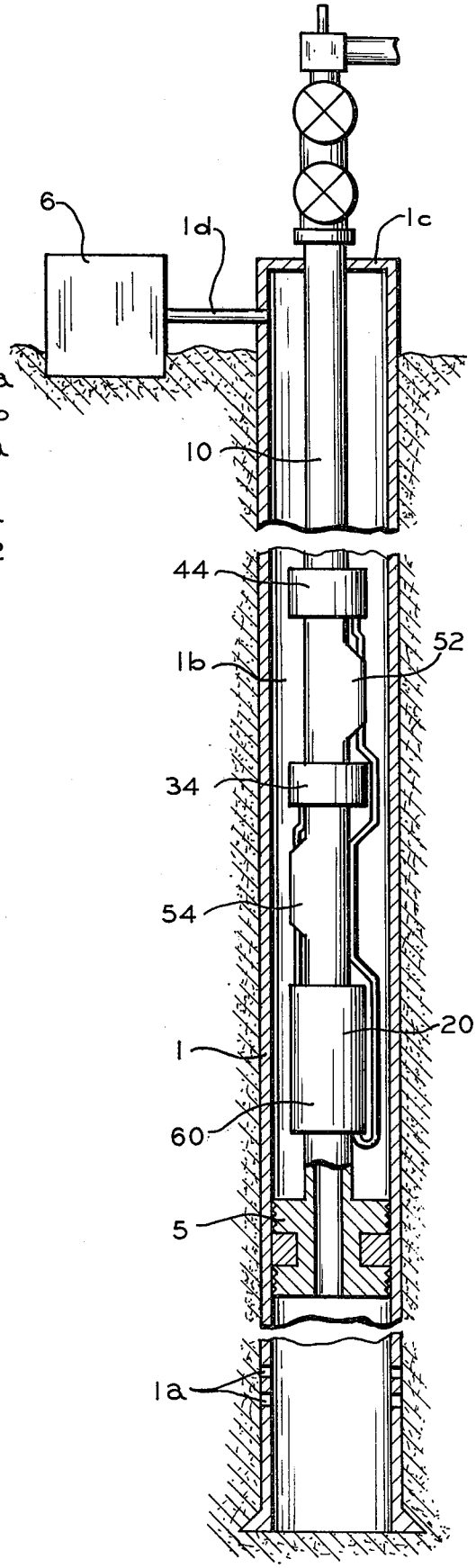
FIG. 2 is a schematic elevational view illustrating the installation position of the various control elements relative to the control valve and the production string of a subterranean well.

Referring now to FIG. 2, it will be seen that the flow valve 20 is preferably disposed adjacent the bottom of the well, immediately above the packer 5 which produces a conventional seal between the bottom end of the production tubing 10 and the interior of the well casing 1. The production zone of the well is indicated by the perforations 1*a* provided in the casing 1 below the packer 5. Between the production tubing 10 and the interior of the casing 1, there is thus defined an annulus 1*b* extending to the well head. This annulus 1*b* is customarily filled with fluid, which normally is a specially treated completion fluid. The annulus 1*b* is closed at its top end by a barrier 1*c* and connected by a conduit 1*d* to a pumping unit 6 which is capable of producing cyclic variations in the absolute pressure of the fluid contained in the annulus 1*b*. The absolute pressure variation in the annulus fluid is obviously a function of the depth of the well and the pressures existing at the portion of the well where the flow valve 20 is located. Normally, a cyclic pressure variation on the order of 100 to 500 pounds per square inch is employed. The pump 6 may be any one of several commercially available types, but preferably comprises a pump shown in the co-pending application Ser. No. 73,335, filed, Sept. 7, 1979, entitled "Pump Assembly Comprising Gas Spring Means", and co-pending application Ser. No. 80,747, filed Oct. 1, 1979, entitled "Apparatus For Pumping Fluid From A Well", each of said co-pending applications being assigned to the same assignee of this present invention.

Referring again to FIG. 1, the high pressure controller 30 is designed to produce a unidirectional pressure signal which is proportional to the peak values of the cyclic pressure produced in the annulus fluid by the pump 6. Conversely, the low pressure controller 40 is designed to produce a unidirectional pressure signal that is proportional to the lower or bottom portions of the cylically varying pressure of the annulus fluid. The high pressure controller 30 incorporates an inlet 30*a* exposed to the annulus fluid and permitting such cyclically varying pressured fluid to impinge directly upon a floating piston 31 mounted for reciprocation in a cylindrical bore 32. The chamber 32*a* defined above piston 31, is filled with an appropriate fluid, such as oil, and two conduits 33*a* and 33*b* are respectively provided between the chamber 32*a* and a lower chamber 34*b* of an accumulator 34. The conduit 33*a* is normally closed by a check-valve 35, while fluid conduit 33*b* comprises a limited flow bleed orifice. A floating piston 36 is provided in the chamber 34 and the space 34*a* above piston 36 constitutes a pressure accumulating chamber which may be precharged at the surface with either a gas or liquid, depending upon the magnitude of the absolute pressure to which the apparatus is exposed in the particular well. A conduit 37 leads from the chamber 34*b* disposed beneath the piston 36 to the cylinder chamber 27 within which the piston 26 is operative.

Thus, as the absolute pressure of the annulus fluid increases, due to the cyclic pressure applied by the pump 6 at the well head, the floating piston 31 moves upwardly and produces a flow of fluid from the reservoir 32*a* through the check valve 35 and into the reservoir 34*b* thus producing an upward motion of the piston 36, further compressing the gas or fluid trapped in the upper chamber 34*a*. The result is that the pressure in the chamber 27 above the valve actuating piston 26 is substantially increased sufficient to overcome the bias of the spring 25 and maintain the safety valve 20 in its open position. The reduction of the cyclic pressure below such peak values, however, effects a closing of the check valve 35 and the maintenance of a slightly decreasing unidirectional pressure in the chamber 27 by virtue of the return of the piston 36 to its starting position by the higher pressure existing in the reservoir chamber 34*b*. The reduction in this pressure value is limited by the bleeding action of the orifice passage 33*b*. Thus, as the cyclic pressure of the annulus fluid decreases, a slight decrease is experienced in the pressure applied to the chamber 27 above the actuating piston 26 as represented by the line PH in FIG. 3, but this reduction is not sufficient to cause valve 20 to close.

The low pressure controller 40 is very similar in construction to the high pressure controller 30, but generates a unidirectional pressure signal that is responsive to the low portions of cyclic pressure of the annulus fluid. Thus, the annulus fluid pressure is applied to the entrance 40*a* of a cylindrical bore 41 within which a floating piston 42 is disposed. Above the piston 42, there is a reservoir chamber 41*a* which is connected by two passages 42*a* and 42*b* to the lower chamber 44*a* of an accumulator 44. The upper portion 44*b* of the accumulator chamber 40 is precharged with an appropriate gas or fluid, depending upon the absolute magnitude of the pressure existing at the location of the control apparatus. The lower chamber 44*a* is connected by a conduit 47 to the chamber 28 located on the lower, or spring assisted side of the actuating piston 26. A check valve 45 is disposed in the passage 42*a*, but this check valve prevents flow from the reservoir chamber 41*a* into the pressure accumulating chamber 44*a* anytime that the pressure in the chamber 41*a* exceeds that of the pressure accumulating chamber 44*a*. The passage 42*b* incorporates a bleed orifice to permit a high pressure in the reservoir chamber 41*a* to slowly bleed into the pressure accumulator chamber 44*a*.

Figure 3:
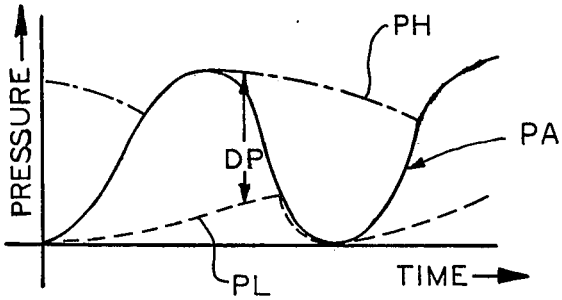
FIG. 3 is a chart illustrating the relative magnitudes of the two pressure signals derived in accordance with this invention from the cyclically varying pressure of the annulus fluid.

The end result of the operation of the low pressure controller is to maintain an output pressure PL which is as low or lower than the cyclic annulus pressure PA. This relationship is shown in FIG. 3. Following the low pressure controller through a cycle of annulus pressure PA:

1. When annulus pressure PA is at its minimum it will be equal to the low pressure controller output PL.
2. As annulus pressure PA increases, the back check valve 45 closes preventing flow through passage 42*a*. Flow occurs from reservoir 41*a* to the pressure accumulator section 44*a* through the bleed passage 42*b*. So as annulus pressure PA increases, the low pressure controller output PL increases at a much slower rate and is controlled by the size of the bleed passage 42*b*.
3. After the annulus pressure PA reaches its maximum pressure, it then declines to the point that it equals the low pressure controller output PL. At this point the back check valve 45 now opens and allows the fluid in the accumulator chamber 44*a* to rapidly flow into fluid reservoir 41*a*. The opening of the back check valve 45 maintains the low pressure controller output PL at essentially the same value as the annulus pressure PA as the annulus pressure decreases to its minimum value as shown in FIG. 3.

The next effect of this sequence is to maintain the pressure in chamber 28 at a value less than or equal to the cyclic annulus pressure PA as shown in FIG. 3.

Since the unidirectional signal pressure PH produced by the high pressure controller 30 is applied to the piston 26 in direct opposition to the pressure PL applied from the low pressure signal generator 40, it is therefore apparent that sufficient pressure will be generated on the piston 26 to shift the piston 26 against the bias of the spring 25 so long as the differential pressure DP, as indicated in FIG. 3, acting over the exposed piston area defined at the seal of the piston 26 is of sufficiently large magnitude to overcome the bias of the spring 25 and maintain the flow valve 20 in its downward position. In the event that the valve 20 is a safety valve, this means that the valve 20 will be maintained in its opened position so long as a sufficient magnitude of cyclically varying pressure is applied to the annulus fluid by the wellhead pump 6.

Figure 4:
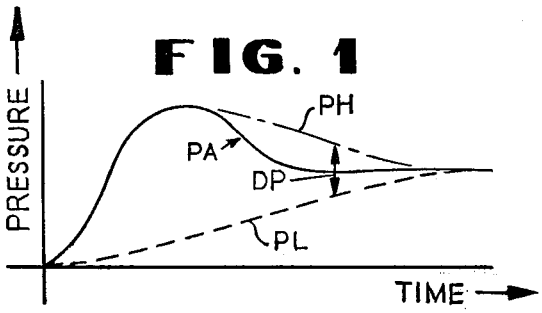
FIG. 4 is a chart similar to that illustrated in FIG. 3 showing the response at the termination of cyclic annulus pressure.

Now referring to FIG. 4, when pump cycling is terminated, both the high pressure controller PH and the output PL of the low pressure controller tend toward the resulting constant annulus pressure PA. When the differential pressure PD reaches some preset value, the spring 25 exerts sufficient force to cause the piston 26 to move up and allow the valve 20 to close. Now, in the event that the cyclic annulus pressure PA is terminated or sufficiently reduced, the valve 20 will close, thus shutting in the well.

The reason for employing the difference between the high pressure signal generated by the unit 30 and the low pressure signal generated by the unit 40 is to completely eliminate any effects of the ambient pressure existing in the lower portions of the well where the apparatus is positioned. The effects of these variations are eliminated through the utilization of the aforedescribed differential pressure method and apparatus.

The apparatus schematically shown in FIG. 1 may be incorporated within the well casing 1 through the employment of conventional constructions. As illustrated in FIG. 2, the pressure accumulator 44 of low pressure signal generator 40 may take the form of an annular housing surrounding the production casing 10. The other valving apparatus embodied in the low pressure signal generator 40, such as the chamber 41, the piston 42, the check valve 45, etc. may be incorporated in a conventional side pocket mandrel 52. Next inline is another annular accumulator 34 which comprises the pressure accumulator chamber 34*a* of the high pressure signal generating apparatus 30. Below this accumulator is a second side pocket mandrel 54 incorporating the cylinder 32, the floating piston 31, and the check valve 35, etc., of the high pressure signal generator 30. The components of the safety valve 20, including the piston 26 and spring 25, may be disposed in an annular housing 60 mounted immediately above the packer 5.

The specific mounting of a described apparatus within the well forms no part of the instant invention inasmuch as conventional mounting techniques may be employed.

The operation of the fluid flow valve by the method and apparatus of this invention, should now be readily apparent. As long as a significant cyclic variation is maintained in the pressure of the annulus fluid, a sufficient bias will be applied to the actuating piston of the control valve to overcome the spring bias on such valve and move the valve to its opened or closed position as the case may be. As soon as the cyclic pressure is interrupted, or significantly decreased in magnitude, the unidirectional differential pressure signal generated by the apparatus of this invention will diminish to a point that it will be unable to overcome the spring bias on the actuating piston of the valve, and the valve will move toward the position to which it is urged by the spring.

In the case of the safety valve, most catastrophic events which require the operation of the safety valve to closed position generally cause a severe disruption to the apparatus disposed at the well head. Any such disruption would immediately effect the discontinuance of the application of a cyclic pressure to the annulus fluid and the spring urging the safety valve to its closed position would be effective to promptly close the valve.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of operating a flow valve installed on a conduit string in a subterranean well and actuable by a piston that is shiftable between two positions and biased toward one of such positions, the conduit string being surrounded by a fluid annulus, comprising the steps of:

(1) producing cyclic variations in the pressure of said fluid annulus;

(2) deriving a pressure signal from said cyclic variations in the pressure of said fluid annulus, during cyclic variation of the pressure in said fluid annulus, and (3) applying said pressure signal to said shiftable piston in a direction in opposition to the bias whereby said shiftable piston is maintained in one position while said cycling of the pressure of the fluid annulus exists and shifts to a second position whenever the effective fluid pressure cycling of the fluid annulus is terminated.

2. The method of operating a flow valve installed on a conduit string in a subterranean well and actuable by a piston shiftable between two positions and biased toward one of the two positions, comprising the steps of:

(1) surrounding the conduit string with a confined fluid annulus;

(2) producing cyclic variations in the pressure of said fluid annulus;

(3) deriving a pressure signal from said cyclic variations in the pressure of said fluid annulus during cyclic variations of the pressure in said fluid annulus, and (4) applying said pressure signal to said shiftable piston in a direction in opposition to the bias thereon, whereby said shiftable piston is maintained in one position while said cycling of the pressure of the fluid annulus exists and shifts to a second position whenever the effective fluid pressure cycling of the fluid annulus is terminated.

3. The method of operating a flow valve installed on a conduit string in a subterranean well having a confined annulus of fluid surrounding the conduit string, said flow valve being actuable by a biased, shiftable piston, comprising the steps of:

(1) produsing cyclic variations in the pressure of said fluid annulus;

(2) deriving a pressure signal from said cyclic variations in the pressure of said fluid annulus, during cyclic variation of the pressure in said fluid annulus, and (3) applying said pressure signal to said biased shiftable piston in a direction in opposition to the bias thereon, whereby said shiftable piston is maintained in one position while said cycling of the pressure of the fluid annulus exists and shifts to a second position whenever the effective fluid pressure cycling of the fluid annulus is terminated.

4. The method of operating a flow valve installed on a conduit string in a subterranean well having a confined annulus of fluid surrounding the conduit string, said flow valve being actuable by a biased, shiftable piston, comprising the steps of:

(1) producing cyclic variations in the pressure of said fluid annulus;

(2) producing a first cyclic control pressure from said fluid annulus that corresponds to the peak portions of the fluid annulus pressure;

(3) producing a second cyclic control pressure from said fluid annulus that corresponds to the lower portions of the fluid annulus pressure, and (4) applying said first and second cyclic control pressures in opposition to said biased piston, during cyclic variation of the pressure in said fluid annulus, with said first control pressure opposing the bias on the piston, whereby said valve is maintained in one position so long as the effective pressure cycling of said fluid annulus is continued and is moved to another position upon discontinuance of the pressure cycling of said fluid annulus.

5. The method of operating a safety valve installed on a conduit string in a subterranean well and actuable to a closed position by a biased, shiftable piston, comprising the steps of:

(1) surrounding the production string witha confined annulus of fluid;

(2) producing cyclic variations in the pressure of said fluid annulus;

(3) producing a pressure control signal from said pressure cycling fluid annulus which is at a maximum during the cycling of the pressure of the fluid annulus and at a minimum when the cycling of the pressure of the fluid annulus is discontinued, and (4) applying said pressurre signal to said shiftable piston in opposition to the bias thereon, during cyclic variation of the pressure in said fluid annulus, to maintain the safety valve in its open position during the continuance of said cyclic pressure in the fluid annulus and causing the safety valve to move to a closed position upon discontinuance of the effective cycling of the pressure of the fluid annulus.

6. The method of operating a safety valve installed on a conduit string in a subterranean well and actuable to a closed position by a biased, shiftable piston, comprising the steps of:

(1) surrounding the conduit string with a confined fluid annulus;

(2) producing cyclic variations in the pressure of said fluid annulus;

(3) producing a first cyclic control pressure from said fluid annulus that corresponds to the peak portions of the fluid annulus pressure;

(4) producing a second cyclic control pressure that corresponds to the lower portions of the fluid annulus pressure, and (5) applying the first and second cyclic control pressure in opposition to said biased piston during cyclic variations of the pressure in said fluid annulus, with said first control pressure opposing the bias on the piston, whereby said safety valve is maintained in its open position so long as the pressure cycling of said fluid annulus is continued and is shiftable by said spring to its closed position whenever the pressure cycling of the fluid annulus is terminated.

7. Apparatus for controlling a flow valve installed on a subterranean well conduit that is surroundable by a fluid annulus, comprising: an actuating piston for the flow valve shiftable between two positions corresponding to the open and closed positions of the flow valve; means for biasing said piston toward one of its said two positions; means for cyclically varying the pressure of said fluid annulus; means for deriving a unidirectional pressure signal from said cyclically varying fluid pressure during cyclic variation of the pressure in said fluid annulus; and means for transmitting said unidirectional pressure signal to said actuating piston in opposition to said bias to shift same to the other of its said two positions, whereby variation of said cyclic fluid pressure causes said actuating piston to shift to its said one position.

8. Apparatus for controlling a flow valve installed on a subterranean well conduit that is surroundable by a fluid annulus, comprising: an actuating piston for the flow valve shiftable between two positions corresponding to the open and closed positions of the flow valve; means for biasing said piston toward one of its said two positions; means for cyclically varying the pressure of said fluid annulus; means for deriving a first unidirectional pressure signal responsive to the peak portions of the cyclically varying annulus fluid pressure; means for deriving a second unidirectional pressure signal responsive to the low portions of the cyclically varying annulus fluid pressure; and means for applying said first and second pressure signals respectively to opposite sides of said actuating piston with each said pressure signal acting to oppose the bias on said piston during cyclic variation of the pressure in said fluid annulus and effective to shift said piston to the other of its said two positions, whereby variation of said cyclic fluid pressure causes said actuating piston to shift to its said one position.

9. Apparatus for controlling a valve installed in a subterranean well flow conduit that is surroundable by a fluid annulus, comprising: an actuating piston for the safety valve shiftable between an open and a closed position of the safety valve; means for biasing said piston toward said closed position; means for cyclically varying the pressure of said fluid annulus; means for deriving a unidirectional pressure signal from said cyclically varying fluid pressure; and means for applying said unidirectional pressure signal to said actuating piston in opposition to said spring during cyclic variation of the pressure in said fluid annulus, thereby effecting the opening of the safety valve, whereby variation of said cyclic fluid pressure causes said actuating piston to shift the safety valve under the bias of said spring to its said closed position.

10. Apparatus for controlling a safety valve installed on a subterranean well production string that is surroundable by a fluid annulus, comprising: an actuating piston for the safety valve shiftable between two positions corresponding to the opened and closed positions of the safety valve; means for biasing said piston toward its said closed position; means for cyclically varying the pressure of said fluid annulus; means for deriving a first unidirectional pressure signal responsive to the peak portions of the cyclically varying annulus fluid pressure; means for deriving a second unidirectional pressure signal responsive to the low portions of a cyclically varying annulus fluid pressure; means for applying said first and second pressure signals respectively to opposite sides of said actuating piston during cyclic variation of the pressure in said fluid annulus, with each said pressure signal acting to oppose the spring bias on said piston, to shift the safety valve to its open position, whereby reduction in or elimination of said cyclically fluid pressure causes said actuating piston to shift said safety valve to its closed position.

11. Apparatus defined in claim 7, 8, 9 or 10 wherein each of said means for deriving a unidirectional pressure signal proportional to portions of the cyclically varying annulus fluid pressure comprise a first floating piston having one side thereof exposed to said cyclically varying annulus pressure; a fluid reservoir on the opposite side of said first piston; a pressure accumulator chamber having a second floating piston; a pressurized trapped fluid on one side of said second floating piston; and fluid connection means between the other side of said second floating piston and said opposite side of said first floating piston including a check valve permitting only unidirectional flow between the fluid chambers respectively adjacent said floating pistons, and a fluid connection from the fluid chamber adjacent the other side of said second floating piston to one side of said actuating piston.

* * * * *